United States Patent [19]

Czech et al.

[11] Patent Number: 4,720,925

[45] Date of Patent: Jan. 26, 1988

[54] LINT FILTER HOUSING FOR A DRYER

[75] Inventors: James I. Czech, Lincoln Township, Berrien County; Creston J. Bruce, St. Joseph Township, Berrien County; Onavie L. Griffith, Lincoln Township, Berrien County, all of Mich.

[73] Assignee: Whirlpool Corporation, Benton Harbor, Mich.

[21] Appl. No.: 945,018

[22] Filed: Dec. 22, 1986

[51] Int. Cl.[4] ..... F26B 11/04

[52] U.S. Cl. ..... 34/82; 34/133; 55/385 R; 55/481

[58] Field of Search ..... 34/133, 82; 432/105; 55/385 R, 481

[56] References Cited

U.S. PATENT DOCUMENTS

| | | | |
|---|---|---|---|
| 2,722,751 | 11/1955 | Steward . | |
| 3,789,514 | 2/1974 | Faust et al. | 34/82 |
| 3,889,392 | 6/1975 | Davis et al. | 34/82 |

*Primary Examiner*—Larry I. Schwartz

*Attorney, Agent, or Firm*—Hill, Van Santen, Steadman & Simpson

[57] ABSTRACT

An automatic clothes dryer includes a lint screen mounted within a lint screen assembly to filter lint entrained in an air flow stream during the drying operation. The lint screen assembly includes a shaped housing spaced close to the peripheral edges of the screen's lint collecting surface, yet spaced further from the screen's midportion to enable quantities of lint to accumulate on the screen and still be removed from the dryer without the risk of the lint falling from the lint screen. The lint screen assembly is held within the dryer only by a pair of fastening screws.

14 Claims, 8 Drawing Figures

LINT FILTER HOUSING FOR A DRYER

BACKGROUND OF THE INVENTION

1. Field of the Invention

The present invention relates to a clothes dryer, and more specifically, to a housing for a lint filter in a dryer.

2. Description of the Prior Art

Clothes dryers, in particular, automatic clothes dryers, generally include lint filtering screens provided in an air flow path downstream of a dryer tumbling drum so that lint and other particulate matter entrained in the air stream is filtered therefrom prior to the air being exhausted from the dryer unit.

Generally, it is recommended that lint filters and screens be cleaned after each dryer load. However, cleaning of the lint filter is often neglected, allowing a quantity of lint to be deposited on the filter. Also, when certain types of articles are dried, greater quantities of lint than normal are produced, causing a heavy build-up on the lint filter. In any case, once the lint build-up has occurred, it impairs the operation of the dryer and, when the filter is removed for cleaning the lint tends to rub on the filter housing and fall off. For dryers having a lint screen at the dryer drum openings, lint falling from the lint screen usually drops into the dryer drum into the area occupied by the clothes load which undesirably redeposits the lint onto the clothes load.

An attempted solution to the problem of lint falling from a lint screen into the dryer drum is disclosed in Steward U.S. Pat. No. 2,722,751 wherein a lint trap 104 is mounted in an air flow duct 63 to trap lint and water vapor entrained in the air flow. The lint trap 104 includes a pair of inwardly directed bent arms 113 on an inner surface of grip elements 109 which prevent accumulated lint from sliding or rolling off the lint trap should the operator fail to clean the lint trap for an extended period of time.

Assignees copending application, Ser. No. 836,297 filed Mar. 5, 1986, utilizes a cover to solve this problem.

SUMMARY OF THE PRESENT INVENTION

An object of the present invention is to prevent accumulated lint on a lint filter screen from becoming dislodged and falling therefrom, such as when the lint filter is removed from the dryer unit.

Another object of the present invention is to provide a high capacity lint filter with controlled lint build-up.

These and other objects are accomplished by a shaped lint filter housing having a distended midportion and confined edge regions for accommodating and controlling the build-up on a lint filter removably mounted within the housing. Edge portions of the housing are relatively closely spaced from the accumulating face of the lint filter as it is disposed within the housing and the midportions of the housing are spaced relatively farther from the lint filter. During operation of the dryer, lint is first uniformly deposited over the entire collecting surface of the filter. As more lint is accumulated it reaches the edge portions of the housing thereby limiting further lint build-up on the filter around the peripheral edge of the filter. Any additional lint accumulation, thus, occurs in the region of the distended midportion of the housing.

It has been found that by limiting lint build-up at the edges of a lint filter, the likelihood of the lint mat becoming dislodged as the filter is removed is significantly reduced. Having the midportion of the housing spaced further from the filter also provides an unhindered air flow path so that there is less impairment of the dryer operation when cleaning of the filter has been neglected for several loads. Thus, more lint can be accumulated on the present screen, particularly as a result of the shaped housing.

Therefore, a significant accumulation of lint on the lint screen can be withdrawn from the lint screen housing of the present invention without risk of the lint dropping onto a freshly laundered load of clothes.

DESCRIPTION OF THE PREFERRED EMBODIMENTS

Figure 1:
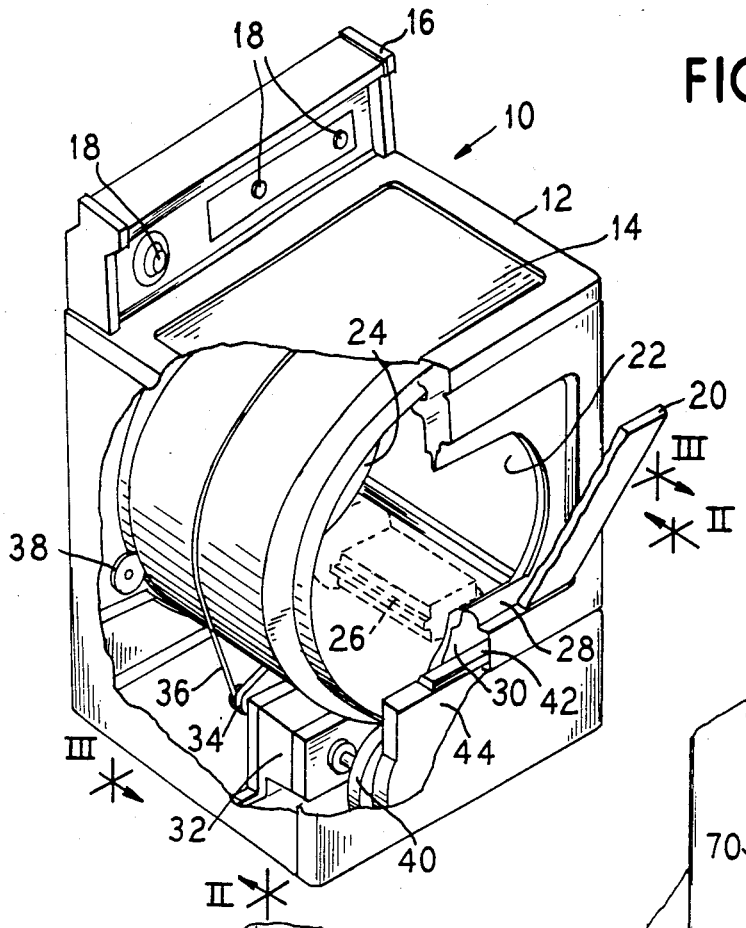
FIG. 1 is a perspective view of a clothes dryer unit including the lint filter assembly of the present invention.

In FIG. 1, there is shown an automatic clothes dryer at 10 having an exterior cabinet 12 with a top panel 14 having a control console 16 along the rear portion thereof incorporating a plurality of controls 18 for selecting an automatic programmed series of drying steps. The dryer cabinet 12 has a front openable door 20 providing access to the interior of a rotatable drying drum 22 which rotates about a horizontal axis and has a non-rotating rear bulkhead 24 with air inlets (not shown) connected to a heater 26, as well as a non-rotating front bulkhead 28 having air outlets 30 therein, for charging the interior of the drum 22 with heated air and for exhausting moisture-laden air, respectively. An electric motor 32 is provided to rotate the drum 22 through a pulley arrangement 34 and a belt 36, the drum 22 being rotated on a plurality of rollers 38. The motor 32 also drives a blower 40 which draws air through the air outlets 30 and through a lint filter 42 in a lint filter assembly 44 and, thus, provides an air flow stream through the interior of the drum 22 and the lint filter assembly 44.

Figure 2:
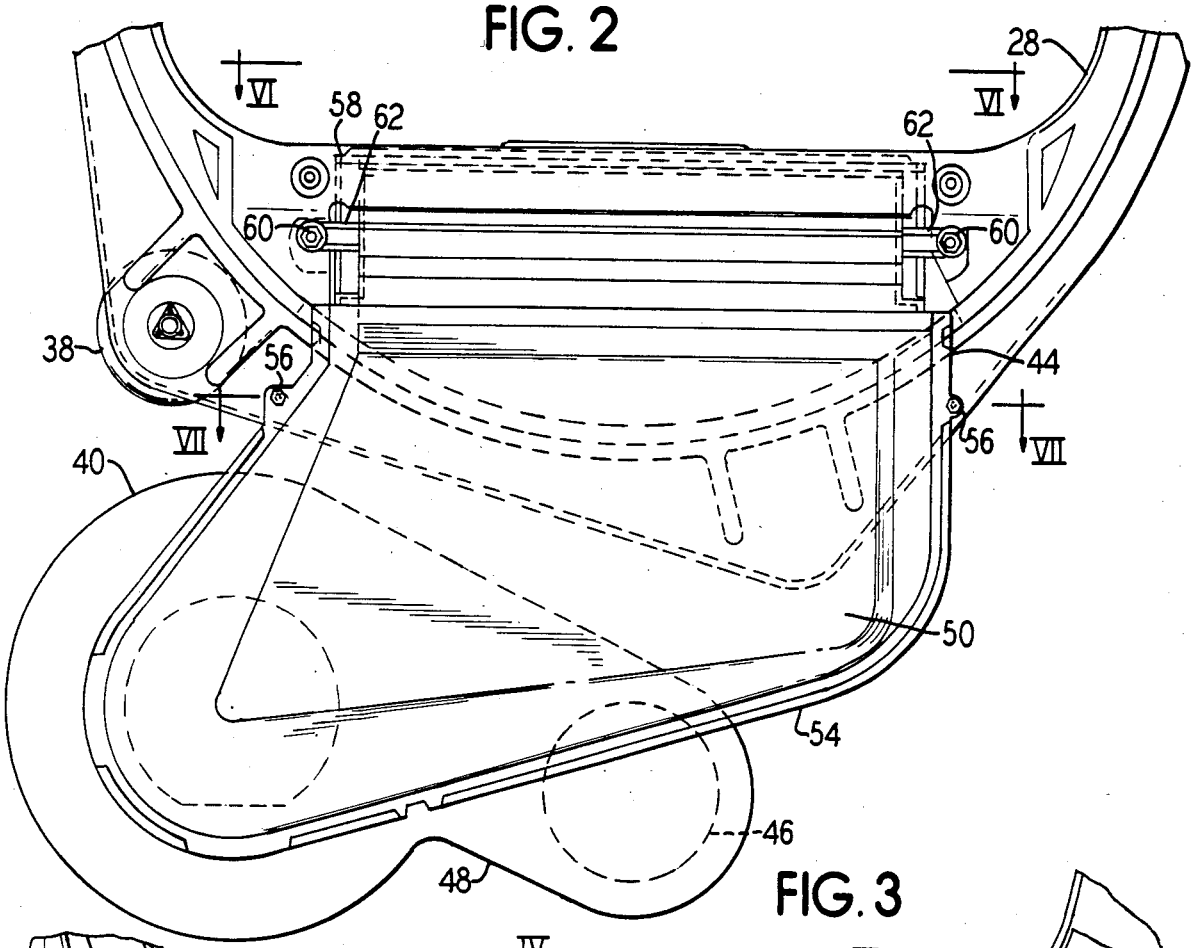
FIG. 2 is an enlarged cross section along the line II—II of FIG. 1 showing the lint filter duct portion of the lint filter assembly.
Figure 3:
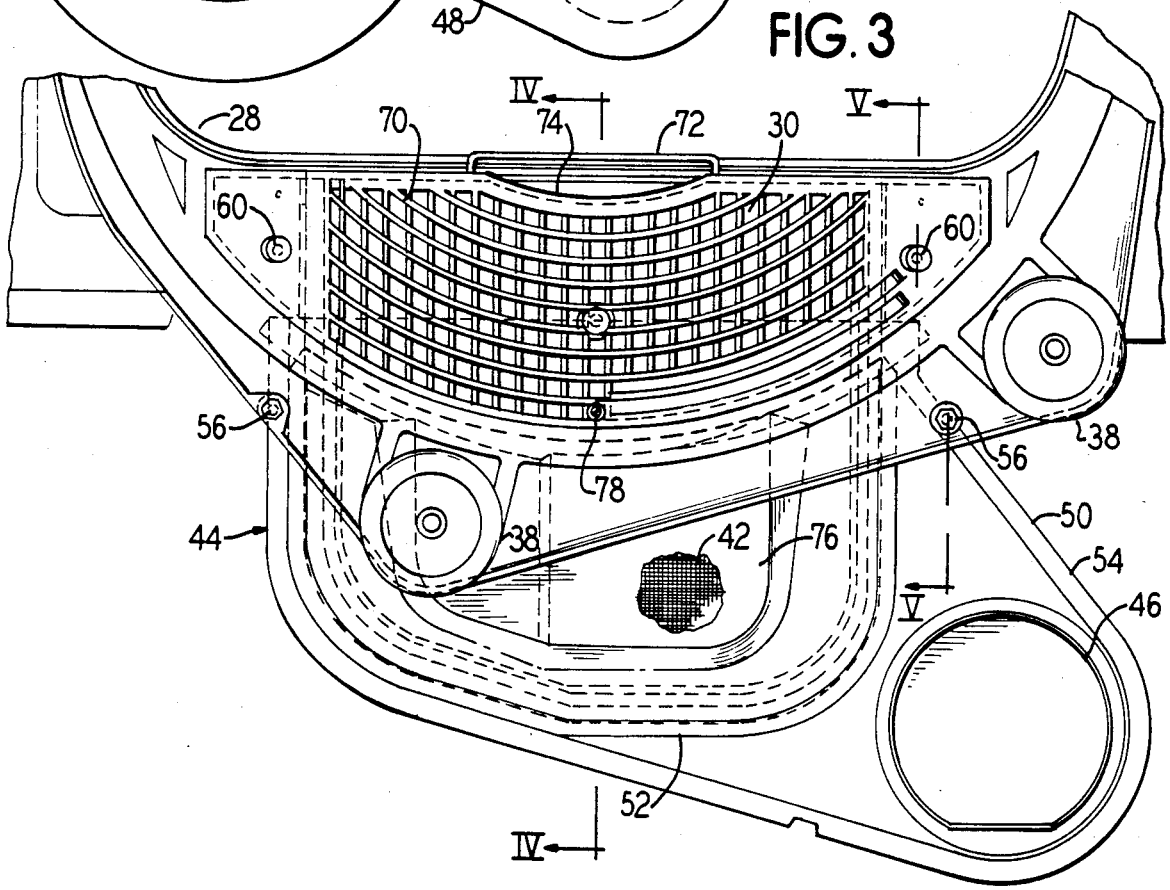
FIG. 3 is an enlarged cross section along line III—III of FIG. 1 showing the lint filter housing and grill mounted to the lint filter duct.

Referring to FIG. 2, the front bulkhead panel 28 is shown from the front with the cabinet 12 removed. The lint filter assembly 44 is mounted to the front bulkhead 28 and to the blower 40, which is connected to an exhaust conduit 46 through a blower housing 48. The lint filter assembly 44 channels air flowing from the front bulkhead 28 to the blower 40 so that the blower can force the air through the blower housing 48 and out the exhaust conduit 46. The lint filter assembly 44 is made up of a lint filter duct 50 at the front and a lint filter housing 52 at the back as shown in FIG. 3. The filter housing 52 is joined to the filter duct 50 by a crimped connection at edges 54. The filter duct 50 is mounted to the bulkhead panel 28 by a pair of bolts 56. Above the filter duct 50 is a housing outlet panel 58, also mounted to the bulkhead panel 28 by bolts 60 extending through lateral tabs 62.

In FIG. 3, a view of the front bulkhead 28 and filter assembly 44 as seen generally from inside the dryer is shown. A grill 70 is provided over an opening in the bulkhead panel 28 to form the air outlets 30 from the drum, which are also the air inlets to the filter assembly 44. Behind the grill 70 is the filter 42 which includes a filter handle 72. The grill 70 includes a curved recess 74 adjacent the handle 72 to provide access to the handle 72. The lint filter 42, which is preferably a screen, fits into the filter housing 52, which has a general pocket shape extending below the grill 70. As shown generally at 76, a deformation is included in the lint filter housing 52 spanning the center thereof below the grill 70. The deformation 76 is spaced further from the screen 42 than the balance of the housing 52.

Figure 4:
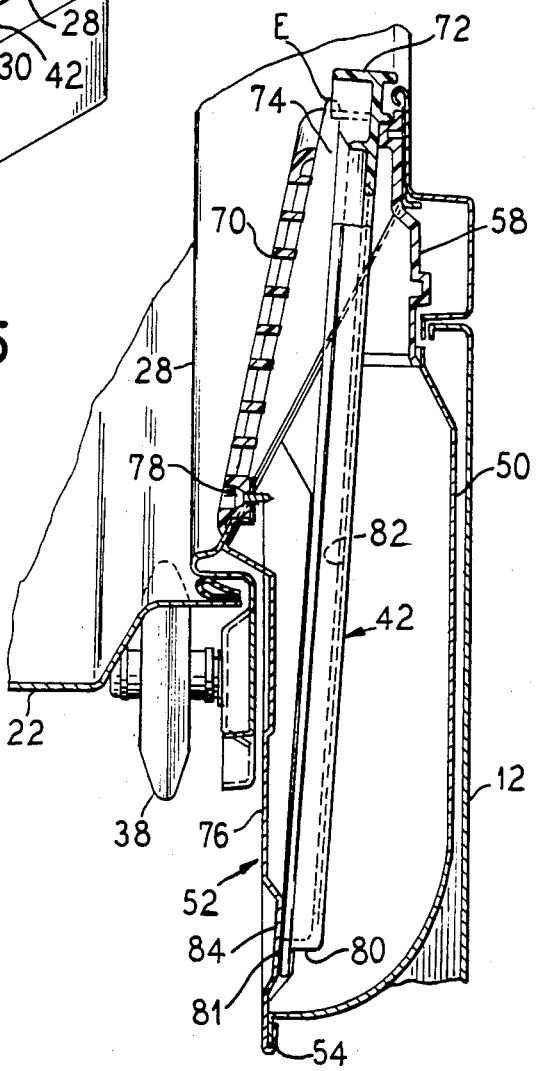
FIG. 4 is a cross section along line IV—IV of FIG. 3 showing the lint filter assembly.

Referring now to FIG. 4, the grill 70 is shown affixed to the bulkhead 28 by a screw 78, the grill 70 providing air access to and being upstream of the screen 42. The lint filter 42 includes a frame 80 with an upstream edge 81 within which is stretched the screen or other filter element that forms a lint collecting surface 82 on its upstream side. Peripheral edge portions 84 of the filter housing 52 are spaced from the lint collecting surface 82 only by the depth of the frame 80, while the distended midportion 76 of the housing 52 is spaced relatively further away from the lint collecting surface 82 of the lint screen 42 to provide additional space for the lint to accumulate.

Figure 5:
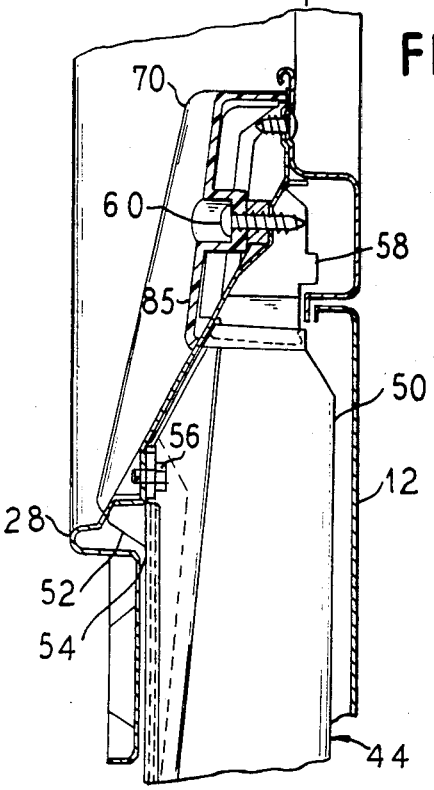
FIG. 5 is a cross section along line V—V of FIG. 3 showing the mounting method for the lint filter assembly.

In FIG. 5 the connection to the dryer bulkhead 28 of an imperforate frame 85 of the grill 70 by the screw 60 is shown. The tab 62 is also fastened by the same screw 60. The crimped edge 54 can be seen in line with the fastening bolt 56 for the filter assembly 44.

Figure 6:
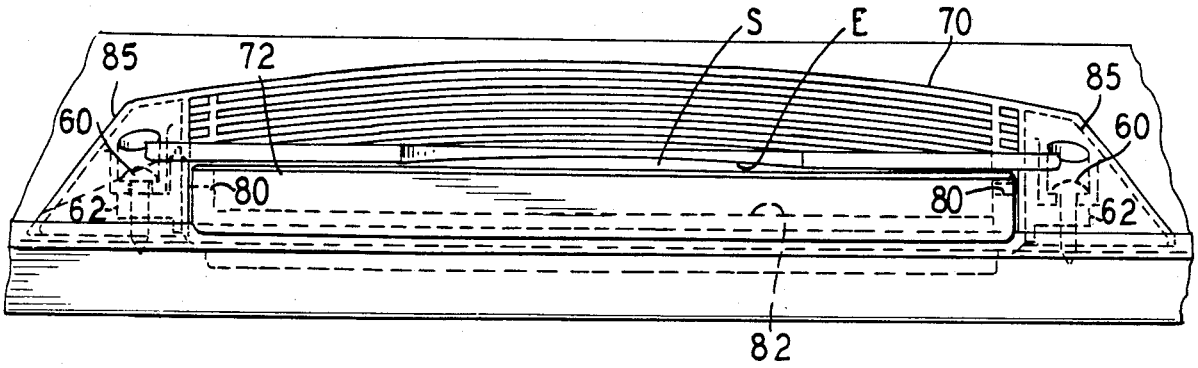
FIG. 6 is a cross section along line VI—VI of FIG. 2 showing the top of the lint filter assembly.

In the top view of FIG. 6, the grill 70 and a portion of the outlet panel 58 define a slot S through which the filter 42 is slidably inserted and removed. The width of the slot S, and particularly the distance from the lint accumulating face 82 of the filter 42 to a forward edge E of the grill 70, permits removal of the lint filter 42 without dislodging the lint mat thereon.

Figure 7:
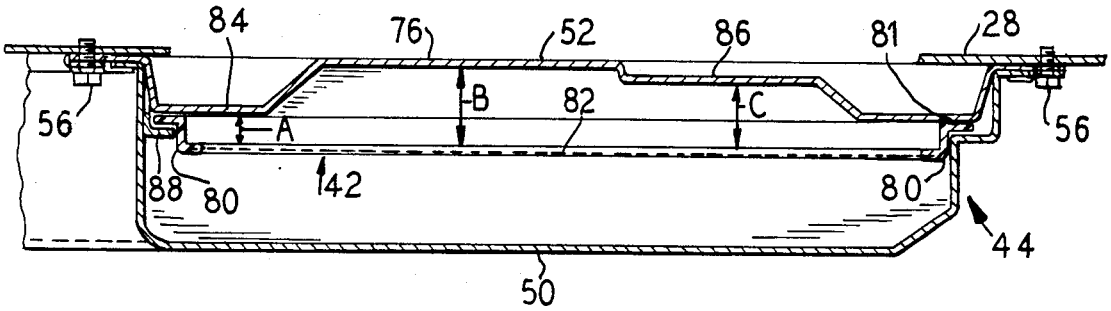
FIG. 7 is a cross-section along line VII—VII of FIG. 2 through the lint filter assembly.

In FIG. 7 a cross section through the lint filter assembly 44 reveals the lint screen 42 in position and its relationship to the front lint duct 50 and the rear lint housing 52. The peripheral edge regions 84 of the housing 52 define a distance A from the lint collecting surface 82, while the midportion 76 defines a greater distance B from the surface 82. The upstream edge 81 of the frame 80 rides against and abuts the peripheral edge regions 84 of the housing 52. Thus, lint can accumulate on the edge regions of the screen 42 to a depth A, further build-up being limited by the edge regions 84, yet the lint can continue to accumulate at the center of the screen 42 to a depth B. As can be seen by comparison of FIGS. 7 and 3, the deformed midportion 76 includes a lesser spaced sub-region 86 at a distance C to accomodate the roller 38 on which the dryer drum 22 rotates.

The screen 42 slidably moves within the filter assembly 44, portion of the frame 80 being received between the duct 50 and the housing 52 as shown at the right side of FIG. 7. Other portions of the frame 80 are held against the housing 52 by a channel 88 as shown at the left of FIG. 7.

Figure 8:
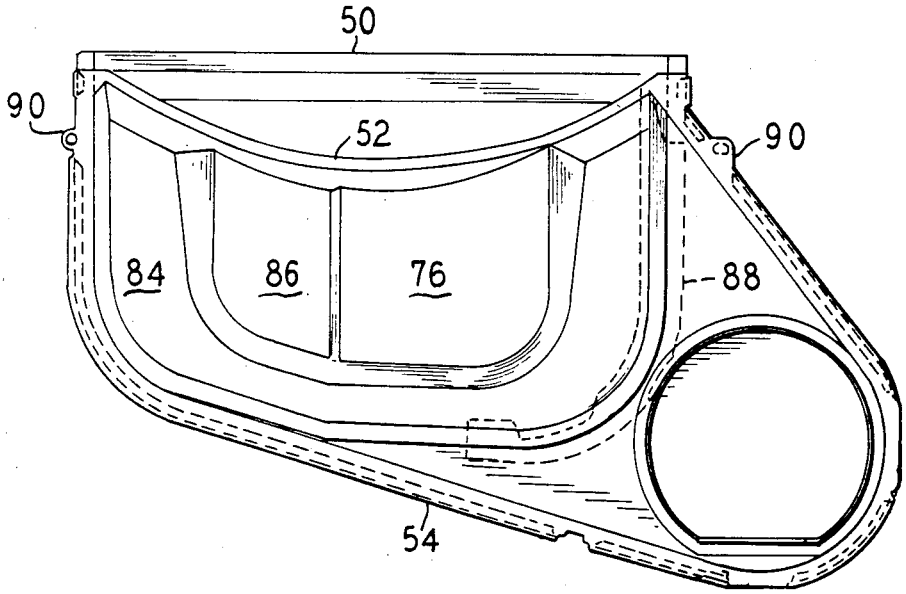
FIG. 8 is an elevational view of the lint filter housing and duct removed from the dryer.

In FIG. 8, the disembodied lint filter assembly 44 is shown, including two mounting tangs 90 by which the entire assembly 44 can be mounted in the dryer 10 by the bolts 56. The channel 88, shown in dotted outline, extends in a J-shape along the inside surface of the housing 52 to hold a portion of the filter frame 80 when the filter 42 is slidably received into the lint assembly 44. The region 84 of the housing 52 extends around nearly all of the filter 42 that is within the assembly 44 to limit lint build-up to the depth A. A greater build-up is permitted at the regions 76 and 86 without affecting the ability to remove the lint-loaded filter 42 and without having the lint accumulation undesirably come off. The regions 76 and 86 are generally of the same shape as the filter 42 which fits therein, but are of a smaller size.

Although the present invention has been disclosed in conjunction with a flow-through type dryer, the use of a similarly shaped lint filter housing is contemplated in other types of dryers as well.

Thus, the present invention provides a housing for a lint filtering screen with restricted edges portions to limit lint build-up thereat and a distended midportion to permit a greater depth of lint to accumulate.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A dryer for drying fabric articles, comprising:

a cabinet;

a dryer drum rotatably mounted within said cabinet for holding a quantity of articles to be dried;

means for providing a flow of heated air within said dryer drum, said air flow means including means for exhausting air from said dryer subsequent to the air passing within said dryer drum;

means for rotating said dryer drum at least during the flow of heated air within said dryer drum;

a lint filter housing forming a part of said air exhausting means downstream of said dryer drum;

a lint filter removably mounted in said lint filter housing, said lint filter having a lint accumulating face directed upstream with respect to the air flow when said filter is in said filter housing;

said lint filter housing having an imperforate first peripheral region disposed at a first distance from said lint accumulating face, said lint filter housing having an imperforate second midportion region disposed at a second distance from said lint accumulating face, said first peripheral region extending along at least three sides of said lint accumulating face and partially around said second midportion region, said first distance being less than said second distance;

whereby lint accumulation on said lint filter is restricted by said first region as compared to possible lint accumulation at said second region.

2. A dryer as claimed in claim 1, wherein said lint filter includes:

a peripherally extending frame;

a screen extending across said frame to form said lint accumulating face, said lint accumulating face being spaced said first distance from an upstream edge of said frame; and said first region of said lint filter housing abutting said upstream edge of said frame.

3. A dryer as claimed in claim 1, further comprising means for accepting edge portions of said lint filter when said lint filter is within said housing, said edge accepting means including a channel member.

4. A dryer as claimed in claim 1, wherein said first region extends inwardly from the perimeter of said lint filter when in said filter housing and said second region is at a midportion of said lint filter when said lint filter is in said housing.

5. A dryer as claimed in claim 1, wherein said lint filter housing includes a front filter duct panel and a rear filter housing panel, said rear housing panel shaped to define said first region and said second region.

6. A dryer as claimed in claim 5, wherein said front duct panel and said rear housing panel are crimped together.

7. A dryer as claimed in claim 1, wherein said filter housing comprises an outlet grate having through extending openings for said air flow, said outlet grate being upstream of said lint filter.

8. A dryer as claimed in claim 1, wherein said second region is substantially the same shape as said filter but of a smaller size.

9. A dryer as claimed in claim 1, wherein said second region includes at least one subregion spaced different a distance from said lint accumulating face, said different distance being greater than said first distance.

10. A flow-through dryer, comprising:

a cabinet including an openable door;

a dryer drum rotatably mounted in said cabinet for receiving articles to be dried and accessible by said openable door;

means for rotating said dryer drum;

a stationary rear bulkhead including air inlets in communication with the interior of said dryer drum;

means for providing heated air to said air inlets;

a stationary front bulkhead including air outlets in communicatin with the interior of said dryer drum;

means for generating air flow through said dryer drum;

a filter assembly in communication with said air outlets;

a filter removably mounted in said filter assembly, said filter having a material accumulating face directed upstream with respect to said air flow;

said filter assembly including at least first and second regions defining respectively first and second distances from said material accumulating face, said first regions inhibiting material build-up on said material accumulating face to a depth greater than said first distance, said first regions extending inwardly from edges of said material accumulating face to partially surround said second regions, said second regions extending in a direction of removal for said filter to enable accumulated material of a depth greater than said first distance to be removed with said filter.

11. A flow-through dryer as claimed in claim 10, wherein said first distance is less than said second distance, said first regions being adjacent at least portions of the edge of said filter, whereby the build-up of material along the edges of said filter is limited by said first regions for removal of said filter from said dryer without disengaging said material from said filter.

12. A flow-through dryer as claimed in claim 10, wherein said first and second regions are below said air outlets.

13. A lint screen assembly for a dryer, comprising:

a housing having air inlet openings and an air exhaust opening an an open slot providing access into the interior of said housing;

a lint filter element having a peripheral frame sized to fit through said housing slot with a screen material attached to said frame to form a continous collection area within the confines of said frame;

said lint filter element being positioned between said air inlet openings and said exhaust opening and having a lint collection side facing toward said inlet openings;

said housing having a front panel forming a portion of said housing disposed on the lint collection side of said filter screen element, said front panel having a planar peripheral portion opposite and spaced a first distance from a peripheral portion of said filter screen material and a planar central portion opposite and spaced a second, greater distance from a central portion of said filter screen material, said planar peripheral portion lying in a plane distinct from said planar central portion;

whereby lint build-up on said screen material is limited to a thickness equal to said first distance at said peripheral portion of said screen and is free to accumulate to a thickness equal to said second distance at said central portion of said screen.

14. A lint screen assembly according to claim 13, wherein a distance from a portion of said housing forming said slot opening to said screen material is greater than said first distance, whereby a clearance is thus provided for said lint build-up at said peripheral portion of said screen material.

* * * * *